US011141843B2

(12) United States Patent
Mo et al.

(10) Patent No.: US 11,141,843 B2
(45) Date of Patent: Oct. 12, 2021

(54) MOUNTING DEVICE FOR LOCKUP MECHANISM BETWEEN TRANSMISSION AND SHIFT CABLE

(71) Applicant: GAC HONDA AUTOMOBILE CO., LTD., Guangdong (CN)

(72) Inventors: Zhiying Mo, Guangdong (CN); Weitang Li, Guangdong (CN); Feng Zhang, Guangdong (CN)

(73) Assignee: GAC HONDA AUTOMOBILE CO., LTD., Guangzhou (CN)

( * ) Notice: Subject to any disclaimer, the term of this patent is extended or adjusted under 35 U.S.C. 154(b) by 218 days.

(21) Appl. No.: 16/612,749

(22) PCT Filed: Dec. 10, 2018

(86) PCT No.: PCT/CN2018/119981
§ 371 (c)(1),
(2) Date: Nov. 11, 2019

(87) PCT Pub. No.: WO2020/015280
PCT Pub. Date: Jan. 23, 2020

(65) Prior Publication Data

US 2021/0245342 A1 Aug. 12, 2021

(30) Foreign Application Priority Data

Jul. 17, 2018 (CN) ..... 201810793461.7

(51) Int. Cl.
*B25B 27/00* (2006.01)
*B25B 27/14* (2006.01)

(52) U.S. Cl.
CPC ..... *B25B 27/14* (2013.01); *B25B 27/0035* (2013.01)

(58) Field of Classification Search
CPC . B25B 27/00; B25B 27/0035; B25B 27/0064; B25B 27/02; B25B 27/14; F16H 61/22
USPC ..... 269/3, 6, 95
See application file for complete search history.

(56) References Cited

U.S. PATENT DOCUMENTS 3,785,037 A * 1/1974 Erdmann ..... B25B 27/20 29/229
4,919,017 A * 4/1990 Thomas ..... B25B 25/005 29/229

* cited by examiner

*Primary Examiner* — Lee D Wilson
*Assistant Examiner* — Sarah Akyaa Fordjour

(57) ABSTRACT

The present invention provides a mounting device for a lockup mechanism between a transmission and a shift cable, which comprises a pliers body, wherein an upper end of the pliers body is arranged with a positioning member used for positioning a lockup piece, an upper end of the positioning member is provided with a barb portion fitting with the lockup piece, a push rod movable along the lengthwise direction of the pliers body is arranged at the bottom side of the positioning member, a handle is rotatably mounted on the lateral portion of the pliers body, the handle is connected to the push rod by means of a connecting element, and the handle can be rotated about the pliers body to cause the push rod to perform extending and retracting movements along the lengthwise direction of the pliers body.

20 Claims, 2 Drawing Sheets

MOUNTING DEVICE FOR LOCKUP MECHANISM BETWEEN TRANSMISSION AND SHIFT CABLE

FIELD OF THE INVENTION

The present invention relates to the technical field of automobile assembly, more particularly to a mounting device for a lockup mechanism between a transmission and a shift cable.

BACKGROUND OF THE INVENTION

The assembly and connection between the vehicle's shift cable and engine transmission are accomplished by the lockup mechanism. Since the vehicle's shift cable has to be moved several times, it is necessary to make sure the lockup mechanism structure can provide a stable connection between the vehicle's shift cable and the engine transmission. The lockup mechanism mainly comprises a bolt and a lockup piece. The bolt may be arranged to extend through the joint to the soldering block support and the lockup piece may be disposed on inner side than the locking nut of the bolt, and then the lockup piece may be bent to tightly abut on the locking nut, to make the connecting structure stable and reliable.

In the bending process of the lockup piece in the prior art, usually open mouth pliers are used to press the lockup piece and then accomplish the bending process. During the process, one has to tightly grasp the open mouth pliers all the time, apply forces and meanwhile change the pressing direction to the lockup piece. However, such process may be affected by manufacturing conditions and structural design issues. During the process, it is not convenient to perform the bending operation in such a small space. In the case that open mouth pliers are used to assist in assembling, there is a risk that the open mouth pliers may be accidently dropped and the shift cable and engine transmission may be damaged, such that the gear lockup mechanism may be improperly mounted and the lockup piece may not tightly abut thereon, thereby resulting in poor assembly and causing potential safety issues. Thus, it can be seen that the operation processes using open mouth pliers have many serious problems, for example, in quality control, operation efficiency, assembly stability and operation comfort of the members assembling, and an improved mounting device for the lockup mechanism is desired.

SUMMARY OF THE INVENTION

The present invention aims to provide a mounting device for a lockup mechanism between a transmission and a shift cable which can ensure a stable and secure mounting of the lockup mechanism and facilitate easy bending operation of the lockup piece and tight abutment, and have simple and convenient mounting operation.

To this end, the present invention provides a mounting device for a lockup mechanism between a transmission and a shift cable, which comprises a pliers body, wherein an upper end of the pliers body is arranged with a positioning member used for positioning a lockup piece, an upper end of the positioning member is provided with a barb portion fitting with the lockup piece, a push rod movable along the lengthwise direction of the pliers body is arranged at the bottom side of the positioning member, a handle is rotatably mounted on the lateral portion of the pliers body, the handle is connected to the push rod by means of a connecting element, and the handle can be rotated about the pliers body to cause the push rod to perform extending and retracting movements along the lengthwise direction of the pliers body.

In a preferred embodiment, the positioning member may be provided with a positioning groove, the barb portion is provided at the opening end of the positioning groove, and the push rod extends through the bottom portion of the positioning groove.

In a preferred embodiment, the contact surface of the barb portion in contact with the lockup piece may be parallel with the bottom surface of the positioning groove, and the push rod may be perpendicular to the bottom surface of the positioning groove.

In a preferred embodiment, a rotating shaft which is perpendicular to the push rod may be arranged at a side portion of the pliers body, the rotating shaft crosses through the middle portion of the connecting element, and the connecting element has a first end portion connected to one end of the handle and a second end portion connected to one end of the push rod.

In a preferred embodiment, the pliers body is provided at its two sides with a first groove and a second groove, a through hole is provided between the first groove and the second groove, the first groove and the second groove are in communication with each other via the through hole, the rotating shaft and the first end portion of the connecting element are arranged at the first groove side, and the push rod and the second end portion of the connecting element are arranged at the second groove side.

In a preferred embodiment, the connecting element may be defined by a first lever and a second lever which are jointed at an angle, wherein an end of the first lever is connected with the handle, and an end of the second lever is connected with the push rod, the rotating shaft crosses through the joint between the first lever and the second lever, and the first lever and the second lever are perpendicular to each other.

In a preferred embodiment, a guide sleeve is arranged at the top side of the pliers body, wherein an end of the guide sleeve is connected with the bottom portion of the positioning member, and the push rod extends through the guide sleeve.

In a preferred embodiment, the guide sleeve is rotatably mounted on the pliers body, and an adjusting nut for loosening and fastening adjustments of the guide sleeve is screwed on outside on the guide sleeve.

In a preferred embodiment, a reset spring may be sleeved outside the push rod, with one end of the reset spring abutting against an end surface of the guide sleeve and another end of the reset spring abutting against the connecting element.

In a preferred embodiment, a baffle may be arranged at the top side of the barb portion, the baffle may be flush with the end surface of the positioning member, and the top portion of the barb portion may be formed with an inclined surface which is inclined toward the push rod side.

Embodiments of the present invention have advantages as follows.

1. When mounting the lockup mechanism, the lockup mechanism can be positioned by means of the positioning member. After the positioning process, the lockup piece abuts against the end surface of the barb portion. On this occasion, the push rod is not contacted with the locking nut, and the handle is disposed away from the pliers body. Then, one can grasp the handle and bring the handle close to the pliers body, such that the push rod is caused to move towards the lockup piece. During the movement of the handle, the push rod comes into contact with the locking nut. After that, one can continuously exert pressure to rotate the handle, to cause the push rod to press against the locking nut, such that the lockup piece can be bent due to the barb portion. Thus, two ends of the lockup piece can tightly abut on the side portion of the locking nut, ensuring that the lockup piece tightly fits against the locking nut, thereby achieving a stable and secure mounting of the lockup mechanism and improving mounting quality of the lockup mechanism. The entire operation does not require much space for operation, and avoids the risk that tools may be accidently dropped. The operation is convenient and efficient.

2. The positioning member is provided with the positioning groove, the barb portion is arranged at the opening end of the positioning groove, and the push rod extends through the bottom portion of the positioning groove. Herein, the positioning groove provides a space for accommodating the lockup piece and the corresponding locking nut, whereby the lockup mechanism can be held and positioned, and good positioning effect can be obtained. Since the push rod extends through the bottom portion of the positioning groove, the push rod would not be accidently dropped during the bending operation of the lockup piece, which ensures good operation stability.

3. The contact surface of the barb portion in contact with the lockup piece is parallel with the bottom surface of the positioning groove and the push rod is perpendicular to the bottom surface of the positioning groove. Thus, the locking nut can be perpendicularly pressed by the push rod during the pressing operation of the push rod, thereby achieving good pressing effect of the push rod and ensuring that the push rod can be moved stably and would not be accidently dropped.

4. The guide sleeve is arranged at the top side of the pliers body, wherein one end of the guide sleeve is connected with the bottom portion of the positioning member, and the push rod extends through the guide sleeve. Thus, when the push rod performs extending and retracting movements in the guide sleeve, the risk that the push rod may be accidently dropped during the movements is avoided, and the stability of the device is improved. Furthermore, the guide sleeve is rotatably mounted on the pliers body, and the adjusting nut for loosening and fastening adjustments is screwed on outside on the guide sleeve. With such configuration, the guide sleeve may be rotated to cause the positioning member to rotate, thus the positioning member may be rotated through 360 degrees to realize adjustment. Thus, the mounting device can apply to various operation spaces, allow users of all heights to operate comfortably, and has good applicability and adaptability.

5. The reset spring is sleeved outside the push rod, with one end of the reset spring abutting against one end surface of the guide sleeve and another end of the reset spring abutting against the connecting element. Thus, after the bending operation of the lockup piece, the push rod may be reset automatically to facilitate further use of the mounting device.

6. The baffle is arranged at the top side of the barb portion, the baffle is flush with the end surface of the positioning member, and the top portion of the barb portion is formed with an inclined surface which is inclined toward the push rod side. The baffle may sever a position limiting function during operation. Meanwhile, during the positioning process, one can press the baffle to facilitate easy positioning process. Due to the arrangement of the baffle, the mounting device can be operated conveniently and comfortably.

Figure 1:
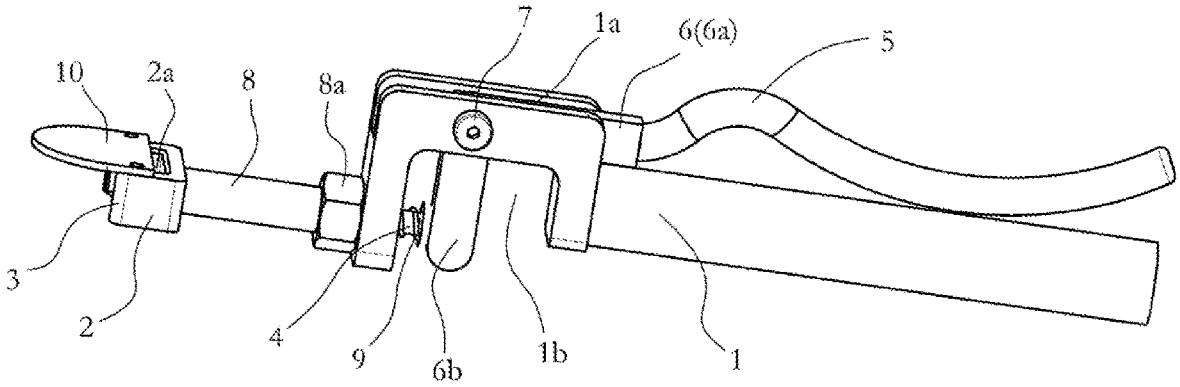
FIG. 1 is a schematic drawing of a device for mounting a lockup mechanism between a transmission and a shift cable according to an embodiment of the present invention.

In the drawings: 1. pliers body; 2. positioning member; 3. barbs; 4. push rod; 5. handle; 6. connecting element; 7. rotating shaft; 8. guide sleeve; 9. reset spring; 10. baffle; 11. lockup mechanism; 12. soldering block support; 1*a*. first groove; 1*b*. second groove; 2*a*. positioning groove; 6*a*. first lever; 6*b*. second lever; 8*a*. adjusting nut; 11*a*. lockup piece; 11*b*. locking nut.

DETAILED DESCRIPTION OF ILLUSTRATED EMBODIMENTS

The technical solution according to embodiments of the present invention will be clearly and completely described below in conjunction with the accompanying drawings illustrating the embodiments of the present invention. It is apparent that, some, but not all embodiments of the present invention are described herein. All embodiments achieved by those skilled in the art based on the embodiments in the present invention without creative work fall within the scope of the present invention.

It should be understood that, in the present invention, terms such as "the first" and "the second" used herein for indicating various elements are merely intended to distinguish same type of elements from one another, but are not necessarily limited to these terms. For example, terms "the first" element may be referred to as "the second" element, and similarly, "the second" element may be referred to as "the first" element, without departing from the scope of the present invention.

Figure 2:
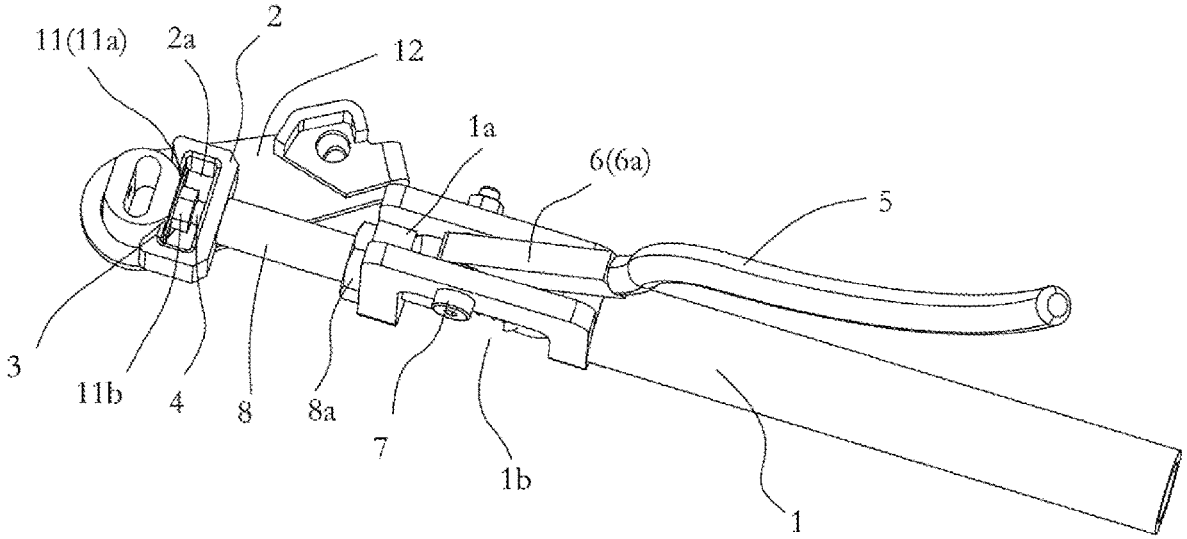
FIG. 2 is a schematic drawing illustrating a device for mounting a lockup mechanism between a transmission and a shift cable according to an embodiment of the present invention, which is in a state of positioning and fitting the lockup mechanism.
Figure 3:
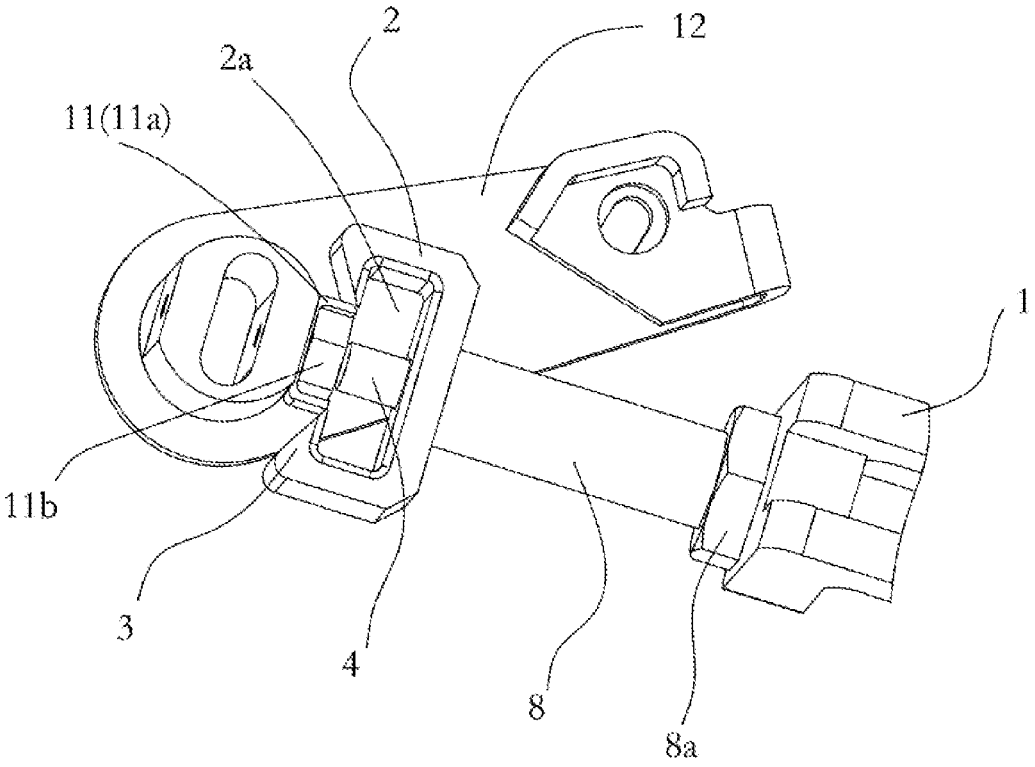
FIG. 3 is a schematic drawing illustrating a device for mounting a lockup mechanism between a transmission and a shift cable according to an embodiment of the present invention, which performs a bending operation of the lockup piece.

Referring to FIGS. 1-3, in the present embodiment, a device for mounting a lockup mechanism between a transmission and a shift cable comprises a pliers body 1, an upper end of the pliers body 1 is arranged with a positioning member 2 used for positioning a lockup piece 11*a*, the mounting device serves a positioning function by means of the positioning member 2, an upper end of the positioning member 2 is provided with barbs 3 fitting with the lockup piece 11*a*, a push rod 4 movable along the lengthwise direction of the pliers body 1 is arranged at the bottom side of the positioning member 2, a handle 5 is rotatably mounted on the lateral portion of the pliers body 1, the handle 5 is connected to the push rod 4 by means of a connecting element 6, and the handle 5 can be rotated about the pliers body 1 to cause the push rod 4 to perform extending and retracting movements along the lengthwise direction of the pliers body 1. Referring to FIGS. 2 and 3, in order to show the structure of the lockup mechanism 11 more clearly, the baffle 10 is not shown. The lockup mechanism 11 is arranged on a soldering block support 12 which serves as the connecting carrier between the vehicle's shift cable and the engine transmission. The lockup mechanism 11 comprises a bolt and a lockup piece 11*a* disposed on the inner side than the locking nut 11*b*, and the screw is not shown. In order to mount the lockup mechanism 11, at first the lockup mechanism 11 can be positioned in such a manner that the barbs 3 abut against an end surface of the lockup piece 11*a*. In such case, the push rod 4 is not contacted with the locking nut 11*b*, and the handle 5 is disposed at a side away from the pliers body 1. Then, one can grasp the handle 5 and bring the handle 5 close to the pliers body 1. In such case, according to the principle of lever, the connecting element 6 is caused to move by means of the handle 5, and further the push rod 4 is caused to move towards the lockup piece 11*a* due to the movement of the connecting element 6. During the movement of the handle 5, the push rod 4 comes into contact with the locking nut 11*b*. After that, one can continuously exert pressure to rotate the handle 5, to cause the push rod 4 to press against the locking nut 11*b*, such that the lockup piece 11*a* can be bent in an opposite direction due to the barbs 3. Accordingly, two ends of the lockup piece 11*a* can tightly abut on the side portion of the locking nut 11*b*, to achieve a stable mounting of the lockup mechanism 11. In the present embodiment, the handle 5 in an original state is disposed at a position away from the pliers body 1, and the lockup piece 11*a* can be bent when the handle 5 is pressed to get close to the pliers body 1. With such arrangement, the operation is convenient and requires less effort. However, it should be noted that other arrangements are conceivable. For example, the handle 5 in an original state may be disposed at a position close to the pliers body 1, and the lockup piece 11*a* can be bent when the handle 5 is pulled. The present embodiment merely provides a preferred technical solution.

According to the technical solution described as above, in order to mount the lockup mechanism 11, the lockup mechanism 11 can be positioned by means of the positioning member 2, and after the positioning process, the lockup piece 11*a* abuts against the end surfaces of the barbs 3. In such case, the push rod 4 is not contacted with the locking nut 11*b*, and the handle 5 is disposed away from the pliers body 1. Then, one can grasp the handle 5 and bring the handle 5 close to the pliers body 1, such that the push rod 4 is caused to move towards the lockup piece 11*a*. During the movement of the handle 5, the push rod 4 comes into contact with the locking nut 11*b*. After that, one can continuously exert pressure to rotate the handle 5, to cause the push rod 4 to press against the locking nut 11*b*, such that the lockup piece 11*a* can be bent by means of barbs 3. Thus, two ends of the lockup piece 11*a* can tightly abut on the side portion of the locking nut 11*b*, ensuring that the lockup piece 11*a* tightly fits against the locking nut 11*b*, thereby achieving a stable and secure mounting of the lockup mechanism 11 and improving mounting quality of the lockup mechanism 11. The entire operation does not require much space for operation, and avoids the risk that tools may be accidently dropped. The operation is convenient and efficient.

In the present embodiment, the positioning member 2 is provided with a positioning groove 2*a*, the barbs 3 are arranged at the opening end of the positioning groove 2*a*, and the push rod 4 extends through the bottom portion of the positioning groove 2*a*. The positioning groove 2*a* provides a space for accommodating the lockup piece 11*a* and the corresponding locking nut 11*b*, whereby the lockup mechanism 11 can be held and positioned, and good positioning effect can be obtained. Since the push rod 4 extends through the bottom portion of the positioning groove 2*a*, the push rod 4 would not be accidently dropped during the bending operation of the lockup piece 11*a*, which ensures good operation stability. Furthermore, since the contact surfaces of the barbs 3 in contact with the lockup piece 11*a* are parallel with the bottom surface of the positioning groove 2*a* and the push rod 4 is perpendicular to the bottom surface of the positioning groove 2*a*, the locking nut 11*b* can be perpendicularly pressed by the push rod 4 during the pressing operation of the push rod 4, thereby achieving good pressing effect of the push rod 4 and ensuring that the push rod 4 can be moved stably and would not be accidently dropped.

Herein, a rotating shaft 7 which is perpendicular to the push rod 4 is arranged at a side portion of the pliers body 1, the rotating shaft 7 crosses through a middle portion of the connecting element 6, and the connecting element 6 has a first end portion connected to an end of the handle 5 and a second end portion connected to an end of the push rod 4. According to such configuration, the connecting element 6 can be rotated about the rotating shaft 7, and the handle 5 is connected with the push rod 4 by means of the connecting element 6. Further, an end of the handle 5 is connected to the first end portion of the connecting element 6, and the handle 5 can rotate about the rotating shaft 7 as a fulcrum to cause the push rod 4 to perform extending and retracting movements according to the principle of lever. That is, in the case that the handle 5 is rotated about the rotating shaft 7, the second end portion of the connecting element 6 can be caused to push, whereby the push rod 4 can be pushed. Such configuration of the mounting device using the rotating shaft 7 has a rational design of integral structure and is more convenient to assemble and disassemble for maintenance.

In particular, the pliers body 1 is provided at its two sides with a first groove 1*a* and a second groove 1*b*, a through hole is provided between the first groove 1*a* and the second groove 1*b*, the first groove 1*a* and the second groove 1*b* are in communication with each other via the through hole, the rotating shaft 7 and the first end portion of the connecting element 6 are arranged at the side where the first groove 1*a* is provided, and the push rod 4 and the second end portion of the connecting element 6 are arranged at the side where the second groove 1*b* is provided. With such configuration, the pliers body 1 has a hollowed-out structure at two sides, which may ensure structural strength as well as provide operate space for the rotating shaft 7, the connecting element 6 and the handle 5, to facilitate normal operation of the mounting device. Meanwhile, due to the hollowed-out structure, the mounting device has a reduced weight. Thus, the pliers body 1 is lightweight and is convenient to operate, and the bending operation of the lockup piece 11*a* requires less effort. Furthermore, the connecting element 6 is bent to form a first lever 6*a* and a second lever 6*b* which are jointed at an angle, wherein an end of the first lever 6*a* is connected with the handle 5, and an end of the second lever 6*b* is connected with the push rod 4, the rotating shaft 7 crosses through the joint between the first lever 6*a* and the second lever 6*b*, and the first lever 6*a* and the second lever 6*b* are perpendicular to each other. In operation, the rotating shaft 7 serves as the fulcrum, and the first lever 6*a* and the second lever 6*b* serve as two arms of the lever. Due to the perpendicular arrangement of the first lever 6*a* and the second lever 6*b*, two arms of the lever are optimized. In such case, the rotation of the handle 5 requires less effort, and comfort bending operation of the mounting device is provided.

In order to make the extending and retracting movements of the push rod 4 stable, a guide sleeve 8 is arranged at the top side of the pliers body 1, wherein an end of the guide sleeve 8 is connected with the bottom portion of the positioning member 2, and the push rod 4 extends through the guide sleeve 8. Thus, in the case that the push rod 4 performs extending and retracting movements in the guide sleeve 8, the risk that the push rod 4 may be accidently dropped during the movements is avoided, and the stability of the device is improved. Furthermore, the guide sleeve 8 is rotatably mounted on the pliers body 1, and an adjusting nut 8*a* for loosening and fastening adjustments is screwed on outside on the guide sleeve 8. With such configuration, the guide sleeve 8 may be rotated to cause the positioning member 2 to rotate, whereby the positioning member 2 may be rotated through 360 degrees to realize adjustment. In such case, the assembling angle of the mounting device may be adjusted depending on various operation spaces, to meet assembling requirements of various operations. Thus, the mounting device can apply to various operation spaces, allow users of all heights to operate comfortably, and has good applicability and adaptability.

Preferably, a reset spring 9 may be sleeved outside the push rod 4, with one end of the reset spring 9 abutting against an end surface of the guide sleeve 8 and another end of the reset spring 9 abutting against the connecting element 6. Thus, after the bending operation of the lockup piece 11*a*, the push rod 4 may be reset automatically to facilitate further use of the mounting device.

In addition, a baffle 10 may be arranged at the top side of the barbs 3, the baffle 10 may be flush with the end surface of the positioning member 2, and the top portion of each barb 3 may be formed with an inclined surface which is inclined toward the side where the push rod 4 is arranged. Due to the inclined surfaces, a contact between edges of the barbs 3 and the soldering block support 12 can be avoided during operation. Thus, the device can be operated stably. Further, the baffle 10 may sever a position limiting function during operation. Meanwhile, during the positioning process, one can press the baffle 10 to assist in the positioning process. Due to the arrangement of the baffle 10, the mounting device can be operated conveniently and comfortably.

When using the device for mounting the lockup mechanism between the transmission and the shift cable according to the embodiments of the present invention, in order to mount the lockup mechanism 11, the lockup mechanism 11 can be positioned by means of the positioning member 2, and after the positioning process, the lockup piece 11*a* abuts against the end surfaces of the barbs 3. In such case, the push rod 4 is not contacted with the locking nut 11*b*, and the handle 5 is disposed away from the pliers body 1. Then, one can grasp the handle 5 and bring the handle 5 close to the pliers body 1, such that the push rod 4 is caused to move towards the lockup piece 11*a*. During the movement of the handle 5, the push rod 4 comes into contact with the locking nut 11*b*. After that, one can continuously exert pressure to rotate the handle 5, to cause the push rod 4 to press against the locking nut 11*b*, such that the lockup piece 11*a* can be bent by means of barbs 3. Thus, two ends of the lockup piece 11*a* can tightly abut on the side portion of the locking nut 11*b*, ensuring that the lockup piece 11*a* tightly fits against the locking nut 11*b*, thereby achieving a stable and secure mounting of the lockup mechanism 11 and improving mounting quality of the lockup mechanism 11. The entire operation does not require much space for operation, and avoids the risk that tools may be accidently dropped. The operation is convenient and efficient.

It should be understood that the terms, such as "up", "down", "left", "right", "top" and "bottom" as used in the description, refer to position and orientation relationships in accordance with drawings for convenience of description and for the purpose of simplicity. They are not intended to indicate or hint a limitation in terms of specific orientation or configuration and operation with specific orientation to the described device or element and should not be regarded as limiting.

All the above are merely preferred embodiments of the present invention. It should be noted that, those skilled in the art may obtain various modifications and equivalent arrangements included within the scope of the present invention without departing from the principle and technical essence of the present invention.

The invention claimed is:

1. A mounting device for a lockup mechanism between a transmission and a shift cable, wherein the mounting device comprises a pliers body, an upper end of the pliers body is arranged with a positioning member used for positioning a lockup piece, an upper end of the positioning member is provided with a barb portion fitting with the lockup piece, a push rod movable along a lengthwise direction of the pliers body is arranged at a bottom side of the positioning member, a handle is rotatably mounted on a lateral portion of the pliers body, the handle is connected to the push rod by means of a connecting element, and the handle can be rotated about the pliers body to cause the push rod to perform extending and retracting movements along the lengthwise direction of the pliers body.

2. The mounting device for the lockup mechanism between the transmission and the shift cable according to claim 1, wherein the positioning member is provided with a positioning groove, the barb portion is provided at an opening end of the positioning groove, and the push rod extends through a bottom portion of the positioning groove.

3. The mounting device for the lockup mechanism between the transmission and the shift cable according to claim 2, wherein a contact surface of the barb portion in contact with the lockup piece is parallel with a bottom surface of the positioning groove, and the push rod is perpendicular to the bottom surface of the positioning groove.

4. The mounting device for the lockup mechanism between the transmission and the shift cable according to claim 1, wherein a rotating shaft which is perpendicular to the push rod is arranged at a side portion of the pliers body, the rotating shaft crosses through a middle portion of the connecting element, and the connecting element has a first end portion connected to an end of the handle and has a second end portion connected to an end of the push rod.

5. The mounting device for the lockup mechanism between the transmission and the shift cable according to claim 4, wherein the pliers body is provided at two sides with a first groove and a second groove, a through hole is provided between the first groove and the second groove, the first groove and the second groove are in communication with each other via the through hole, the rotating shaft and the first end portion of the connecting element are arranged at a side where the first groove is provided, and the push rod and the second end portion of the connecting element are arranged at a side where the second groove is provided.

6. The mounting device for the lockup mechanism between the transmission and the shift cable according to claim 5, wherein the connecting element comprises a first lever and a second lever which are jointed at an angle, wherein an end of the first lever is connected with the handle, and an end of the second lever is connected with the push rod, the rotating shaft crosses through a joint between the first lever and the second lever, and the first lever and the second lever are perpendicular to each other.

7. The mounting device for the lockup mechanism between the transmission and the shift cable according to claim 1, wherein a guide sleeve is arranged at a top side of the pliers body, an end of the guide sleeve is connected with a bottom portion of the positioning member, and the push rod extends through the guide sleeve.

8. The mounting device for the lockup mechanism between the transmission and the shift cable according to claim 7, wherein the guide sleeve is rotatably mounted on the pliers body, and an adjusting nut for loosening and fastening adjustments is screwed on outside on the guide sleeve.

9. The mounting device for the lockup mechanism between the transmission and the shift cable according to claim 8, wherein a reset spring is sleeved outside the push rod, with one end of the reset spring abutting against an end surface of the guide sleeve and another end of the reset spring abutting against the connecting element.

10. The mounting device for the lockup mechanism between the transmission and the shift cable according to claim 1, wherein a baffle is arranged at a top side of the barb portion, the baffle is flush with an end surface of the positioning member, and a top portion of the barb portion is formed with an inclined surface which is inclined toward a side where the push rod is arranged.

11. The mounting device for the lockup mechanism between the transmission and the shift cable according to claim 2, wherein a guide sleeve is arranged at a top side of the pliers body, an end of the guide sleeve is connected with a bottom portion of the positioning member, and the push rod extends through the guide sleeve.

12. The mounting device for the lockup mechanism between the transmission and the shift cable according to claim 3, wherein a guide sleeve is arranged at a top side of the pliers body, an end of the guide sleeve is connected with a bottom portion of the positioning member, and the push rod extends through the guide sleeve.

13. The mounting device for the lockup mechanism between the transmission and the shift cable according to claim 4, wherein a guide sleeve is arranged at a top side of the pliers body, an end of the guide sleeve is connected with a bottom portion of the positioning member, and the push rod extends through the guide sleeve.

14. The mounting device for the lockup mechanism between the transmission and the shift cable according to claim 5, wherein a guide sleeve is arranged at a top side of the pliers body, an end of the guide sleeve is connected with a bottom portion of the positioning member, and the push rod extends through the guide sleeve.

15. The mounting device for the lockup mechanism between the transmission and the shift cable according to claim 6, wherein a guide sleeve is arranged at a top side of the pliers body, an end of the guide sleeve is connected with a bottom portion of the positioning member, and the push rod extends through the guide sleeve.

16. The mounting device for the lockup mechanism between the transmission and the shift cable according to claim 2, wherein a baffle is arranged at a top side of the barb portion, the baffle is flush with an end surface of the positioning member, and a top portion of the barb portion is formed with an inclined surface which is inclined toward a side where the push rod is arranged.

17. The mounting device for the lockup mechanism between the transmission and the shift cable according to claim 3, wherein a baffle is arranged at a top side of the barb portion, the baffle is flush with an end surface of the positioning member, and a top portion of the barb portion is formed with an inclined surface which is inclined toward a side where the push rod is arranged.

18. The mounting device for the lockup mechanism between the transmission and the shift cable according to claim 4, wherein a baffle is arranged at a top side of the barb portion, the baffle is flush with an end surface of the positioning member, and a top portion of the barb portion is formed with an inclined surface which is inclined toward a side where the push rod is arranged.

19. The mounting device for the lockup mechanism between the transmission and the shift cable according to claim 5, wherein a baffle is arranged at a top side of the barb portion, the baffle is flush with an end surface of the positioning member, and a top portion of the barb portion is formed with an inclined surface which is inclined toward a side where the push rod is arranged.

20. The mounting device for the lockup mechanism between the transmission and the shift cable according to claim 6, wherein a baffle is arranged at a top side of the barb portion, the baffle is flush with an end surface of the positioning member, and a top portion of the barb portion is formed with an inclined surface which is inclined toward a side where the push rod is arranged.

* * * * *